United States Patent [19]

Gardon

[11] 4,243,344

[45] Jan. 6, 1981

Best Available Copy

[54] INSTALLATION FOR CONVEYANCE OF A BOAT

[75] Inventor: Maurice Gardon, Abbeville, France

[73] Assignee: Delattre-Levivier, Paris, France

[21] Appl. No.: 38,305

[22] Filed: May 11, 1979

[30] Foreign Application Priority Data

May 31, 1979 [FR] France ..... 78 16175

[51] Int. Cl.[3] ..... B63C 3/08

[52] U.S. Cl. ..... 405/2

[58] Field of Search ..... 405/1, 2, 4, 7

[56] References Cited

U.S. PATENT DOCUMENTS

| | | | |
|---|---|---|---|
| 481,405 | 8/1892 | Kinipple | 405/2 |
| 3,221,507 | 12/1965 | Grossman | 405/2 |
| 3,650,115 | 3/1972 | Fiegel et al. | 405/2 |

*Primary Examiner*—David H. Corbin

*Attorney, Agent, or Firm*—Haseltine and Lake

[57] ABSTRACT

An installation including on the one hand trolleys equipped each with a hydraulic jack and roller members and on the other hand parallel supporting-beams which support the boat which is arranged so that its longitudinal axis is perpendicular to these beams which bear upon the jacks of two trolleys running on two parallel tracks, the jacks forming three groups of jacks connected hydraulically so that the resultants of these groups are located at the corners of a triangle, and it is characterized by the fact that it includes at least three parallel tracks upon which the trolleys run which support the supporting-beams which are arranged so as to form at least two lines of beams which are displaced perpendicularly to the longitudinal axis of the boat.

6 Claims, 8 Drawing Figures

1
61
64
II
III
3
21
4
5
22
23
62
13
63

3
21
62
63
4
5
61
64
III
I
1
22
13
23

INSTALLATION FOR CONVEYANCE OF A BOAT

FIELD OF THE INVENTION

The invention refers to an installation which enables a boat to be transported horizontally over firm ground dry. Such an installation is integrated into a more complex installation which enables a boat to be transported from the water up onto firm ground and vice versa.

BACKGROUND

Certain installations for placing ships high and dry or in the water comprise an elevator intended for raising each ship from the water up to the level of the ground. Such an elevator comprises a platform raised by winches. The boat rests on the platform during transport from the water upto the level of the ground, that is to say, upto the position where it emerges. Each boat must then be moved horizontally from the elevator over to a docking position.

Horizontal transport of a ship is generally carried out by means of wheeled trolleys located under the keel of this ship. This mode of transport lacks flexibility for absorbing the unevenesses in the ground and for spreading the load of the ship. Furthermore these trolleys serve only one direction, which limits the number of boats which can be docked over a given area.

In order to avoid this disadvantage an installation has been designed for transport by trolleys, which enables the boat to be moved along any horizontal direction. In this installation the boat rests upon a set of beams arranged perpendicularly to its longitudinal axis. Generally the boat rests upon each beam by a central chock and side chocks for shoring-up. Each beam rests at its ends upon two trolleys which run each upon one two-railed track. The different trolleys are arranged along two lines and each portion of the boat is supported by way of the beam and the trolleys upon four rails, which ensures good distribution of the loads. The beams are connected together by cross-bars. The bearing of each beam upon each trolley is effected by way of a hydraulic jack. This hydraulic jack is double-acting.

The jacks, when the beams are bearing on the ground, enable the trolleys to be raised above the rail and thus to swivel from one track to another track. Hence changes in direction may be achieved. The jacks above all enable the boat to be supported elastically and isostatically with respect to the ground. The jacks supporting the beams are distributed in three groups. All of the jacks of one and the same group are connected together so that the reactions from these jacks are equal. A first group comprises the jacks associated with one fractional part of the trolleys from the line of trolleys running upon one of the tracks. The second group comprises the jacks associated with one fractional part of the trolleys from the line of trolleys running on the other track. The third group groups together the jacks associated with the trolleys located at one end of each line and running upon the two parallel tracks. Each group of jacks is equivalent to an imaginary support at the centre of the geometrical figure which they define. The three resultants due to the three groups of jacks are located at the corners of an isosceles triangle the main height of which is parellel with the longitudinal axis of the boat.

In certain installations the side chocks for shoring-up bear against the beams by way of jacks. These jacks enable the shoring chocks to be adjusted for height as a function of the boat to be supported. The balancing of the loads between the different chocks is in spite of all that imperfect. The shoring-up must be achieved by trial and error and necessitates manual interventions. Apart from this disadvantage concerning the shoring-up, these known installations do not enable ships to be supported which are of heavy tonnage and great width.

SUMMARY OF THE INVENTION

The object of the present invention is an installation intended to ensure the transport of a ship of heavy tonnage while supporting it isostatically. It enables each portion of the ship to be supported isostatically by ensuring balancing of the forces upon the different chocks located under this portion. The side chocks which ensure the stability of the ship when placing it in the water or when leaving the water or during travelling are kept in permanent contact against the hull of the ship. The shoring-up or chocking is achieved automatically.

In accordance with the invention this installation includes on the one hand trolleys equipped each with a hydraulic jack and roller members and on the other hand parallel supporting-beams which support the boat which is arranged so that its longitudinal axis is perpendicular to these beams which bear upon the jacks of two trolleys running on two parallel tracks, the jacks forming three groups of jacks connected hydraulically so that the resultants of these groups are located at the corners of a triangle, and it is characterized by the fact that it includes at least three parallel tracks upon which the trolleys run which support the supporting-beams which are arranged so as to form at least two lines of beams which are displaced perpendicularly to the longitudinal axis of the boat.

In accordance with one characteristic of the invention the beams are arranged along at least three lines.

In accordance with another characteristic of the invention at least one of the groups of jacks connected hydraulically comprises jacks supporting supporting-beams of the central line and jacks supporting supporting-beams of a line to one side.

The invention will now be described in greater detail by referring to embodiments given by way of examples and represented by the drawings attached.

DETAILED DESCRIPTION

Figure 1:
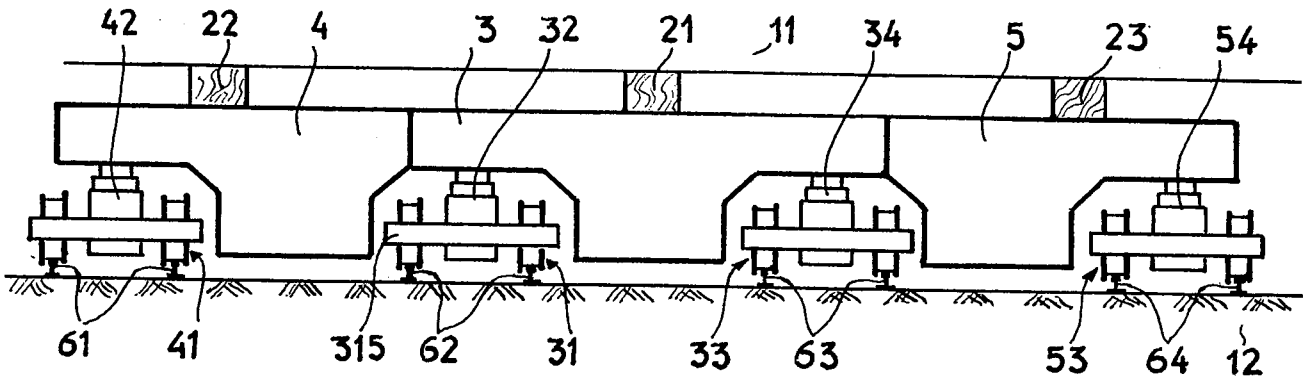
FIG. 1 represents a view perpendicular to the axis of the boat showing the beams and the trolleys supporting the boat.
Figure 3:
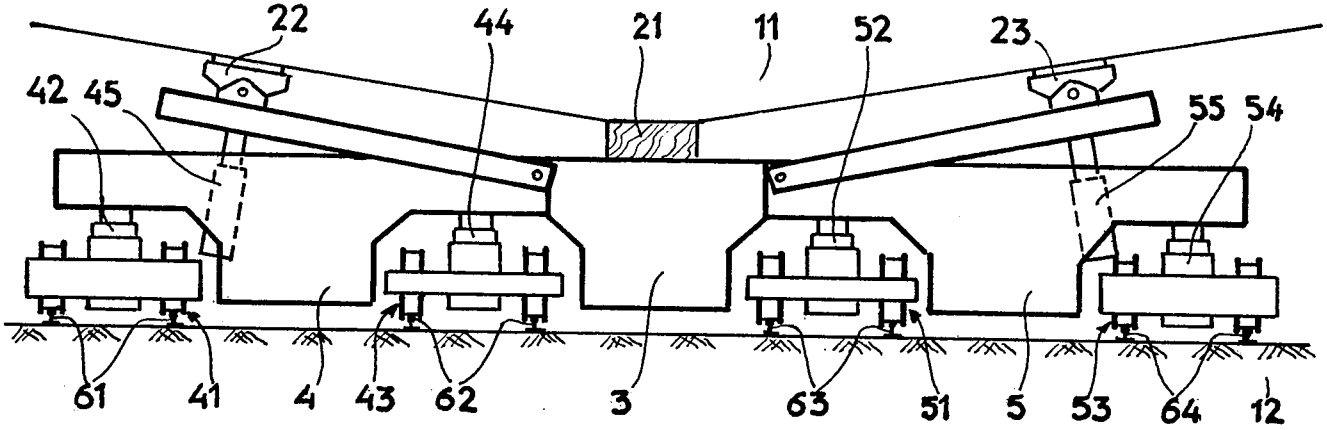
FIG. 3 is variant upon FIG. 1 showing a particular type of bearing of the shoring chocks against the beams.
Figure 2:
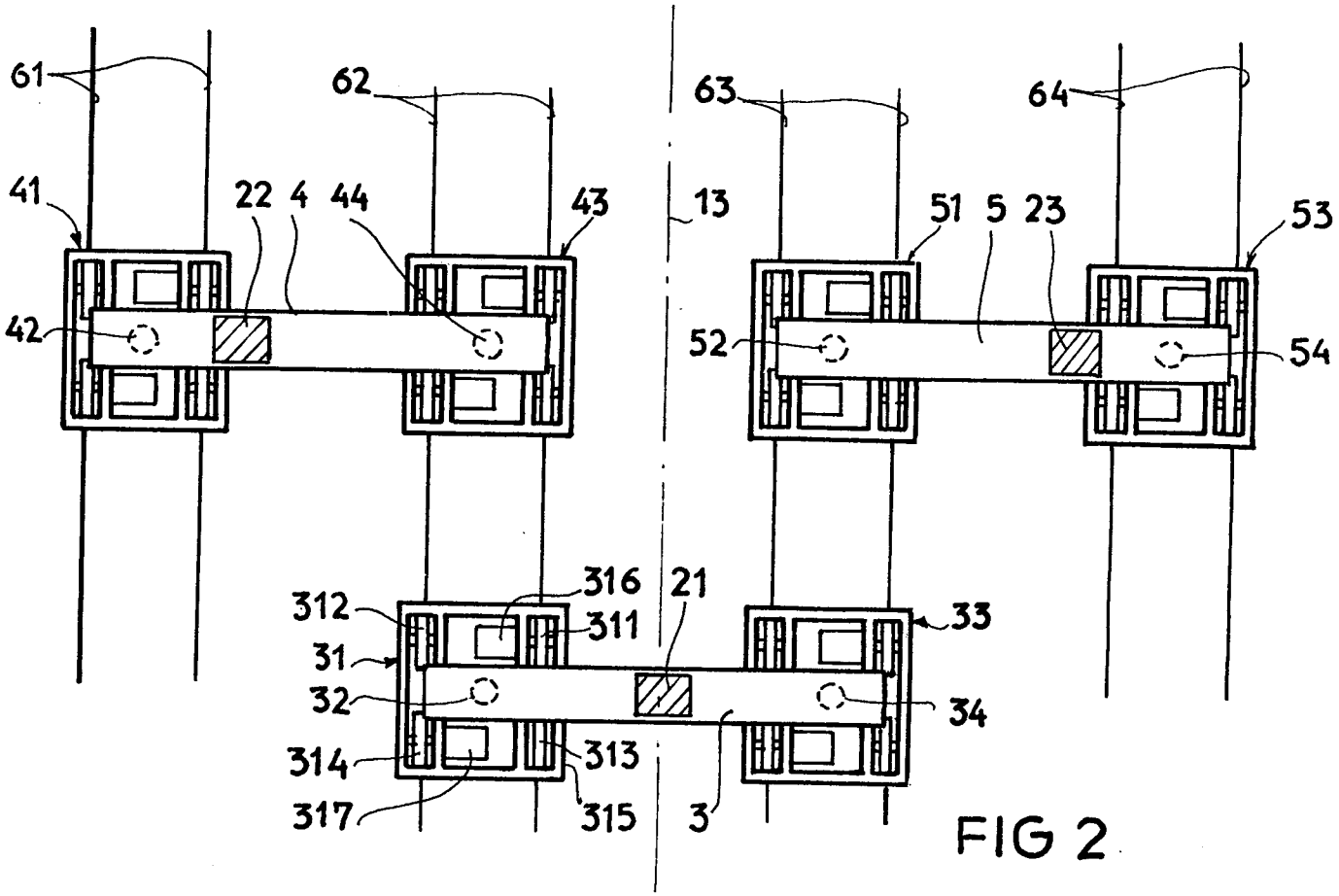
FIG. 2 is a plan of FIG. 1.
Figure 4:
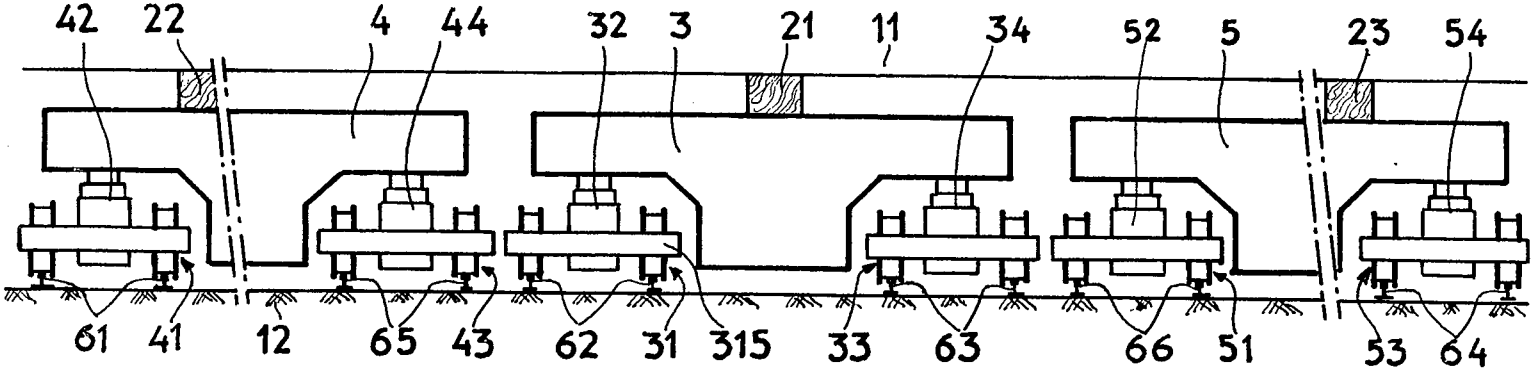
FIG. 4 is a variant upon FIG. 1.

The installation represented in FIGS. 1 to 8 serves to support and transport horizontally a boat 11 over firm ground 12. The boat 11 is moved by way of trolleys 41,43,31,33,51,53 which run upon four parallel tracks 61 to 64 (FIGS. 1 to 3) or upon six tracks 61 to 66 (FIG. 4). The boat 11 bears on the trolleys by way of supporting beams 3,4 and 5 which are arranged in parallel. Each beam rests at its ends upon two trolleys. The boat is arranged so that its longitudinal axis 13 is perpendicular to the longitudinal axis of the beams which pass through the point of bearing on the trolleys. The supporting beams form at least three lines, the associated trolleys running upon at least four tracks. The ends of the beam in each line are aligned in parallel with the axis 13. The beams 3 form the central line. The beams 4 and 5 form lateral lines. Preferably the central beams 3 have their ends symmetrical with respect to the longitudinal axis of the boat.

The boat bears on the central beams 3 by way of central chocks 21. It bears on the side beams 4 and 5 by shoring-chocks 22 and 23 respectively. The supporting beams are joined by ties parallel with the axis of the boat, which are not shown. The central beams 3 are supported by the trolleys 31 and 33. The side shoring-beams 4 are supported by the trolleys 41 and 43. The side shoring-beams 5 are supported by the trolleys 51 and 53. Each supporting beam may rest upon the ground or upon an elevator platform, the trolleys being removed.

The trolleys associated with the beams 3 in the central line run upon the central tracks 62 and 63. At least two side tracks are arranged in parallel with and on opposite sides of the central tracks. The trolleys 41 run upon an outer side track 61, the trolleys 53 run upon an outer side track 64. Each of the tracks comprises two rails. In the installation represented in FIGS. 1 and 2, the trolleys 43 and 51 run respectively on the central tracks 62 and 63. In the installation as FIG. 4, the trolleys 43 and 51 run respectively on side tracks 65 and 66.

The supporting beams are arranged so as to form three lines of beams displaced perpendicularly to the axis 13, because the beams 4 and 5 in the lateral lines are associated with trolleys which run upon tracks separated from the tracks upon which the trolleys run which are associated with the beams 3 in the central line. The centres of the beams 3, that is to say, the points located each at equal distances from the points of bearing of a beam on the trolleys, are aligned upon an imaginary line located between an imaginary line which passes through the centres of the beams 4 of one lateral line and an imaginary line which passes through the centres of the beams 5 of the other lateral line. The ends of the central beams and of the side beams are separated, perpendicularly to the axis 13, with respect to one another.

Each trolley comprises four wheels which run in pairs on the two rails. Thus the trolley 31 comprises four wheels 311,312,313,314 which are guided in bearings in the bogie frame 315. The supporting-beams are parallel or perpendicular to the rails.

Each trolley includes a hydraulic jack. Each supporting beam bears at its ends upon two jacks mounted upon trolleys. Thus each beam 3 bears upon the jacks 32 and 34 mounted respectively on the trolleys 31 and 33. Each beam 4 bears on the jacks 42 and 44 mounted respectively on the trolleys 41 and 43. Each beam 5 bears on the jacks 52 and 54 mounted respectively on the trolleys 51 and 53.

The jacks 32 and 34, 42 and 44, 52 and 54 form three groups. In each group the bottom chambers of the jacks are connected. The hydrostatic pressure being the same at any point in the hydraulic circuit of each group, all the forces developed by the jacks of this group are equal. Thus in FIGS. 6 to 8 the broken lines referenced I,II,III, define the jacks belonging to the three groups. Each group of jacks is equivalent statically to an imaginary point support the resultant of which, referenced R1, R2 or R3, is equal to the sum of the (equal) reactions of the jacks of this group.

The resultants from the three groups of jacks are located at the corners of an isosceles triangle the main height of which is parallel with the longitudinal axis 13 of the boat. The two groups I and II give two resultants which are symmetrical and displaced with respect to the longitudinal axis 13 of the boat. The third group III gives a resultant which passes approximately through the axis 13 of the boat. One can aim at equalizing the loads over all the jacks, that is to say, between the jacks belonging to the different groups. For this purpose the centre of gravity of the ship must be located at the barycentre of the three imaginary points of support, weighted by the number of jacks forming each of these points.

Each of the groups of jacks the resultant of which is displaced comprises some jacks supporting central supporting-beams and some jacks supporting side beams. Thus in the group I some jacks supporting some central beams 3 are connected to some jacks supporting some side beams 4. In the group II some jacks supporting some central beams 3 are connected to some jacks supporting some side beams 5. Certain central beams rest upon a jack connected to the other jacks of one of the groups I or II, the other jack associated with each of these beams being connected to the jacks of the other group. The two supporting jacks of certain central beams form part of the group III the resultant of which is on the axis of the boat. The two supporting jacks of each side beam generally form part of one and the same group. Thus the weight of the boat is transmitted by the chocks 21 onto the supporting-beams 3 and the jacks 32 and 34 are subjected to forces. If the shoring-chocks 22 were not applied against the hull of the boat the interconnection between the jacks of the group I would tend to make the pistons of the jacks 42 and 44 come out. Similarly if the shoring-chocks 23 were not applied against the hull, the interconnection between the jacks of the group II would tend to make the pistons of the jacks 52 and 54 come out.

Figure 6:
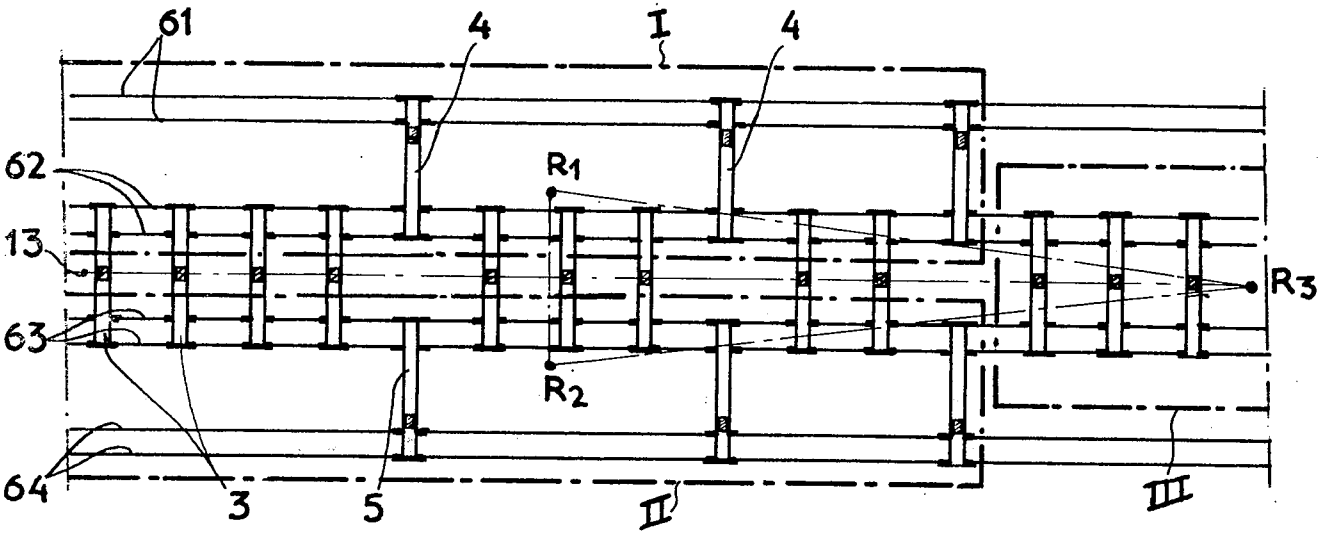
FIG. 6 shows in plan one arrangement of the beams supporting the boat.
Figure 7:
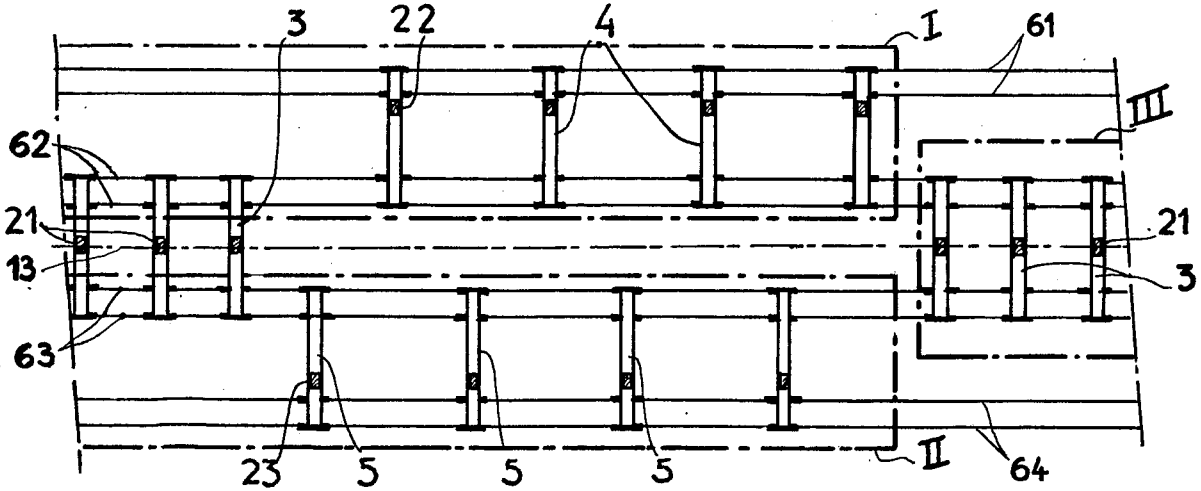
FIG. 7 shows in plan a second arrangement of the beams supporting the boat.
Figure 8:
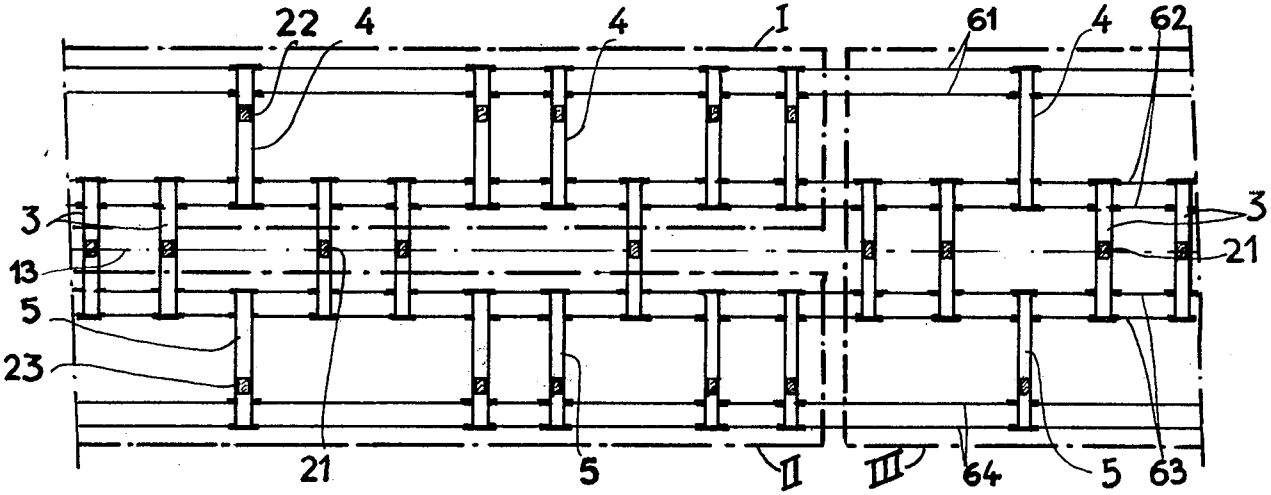
FIG. 8 shows in plan a third arrangement of the beams supporting the boat.

FIGS. 6 to 8 represent various arrangements of the supporting-beams.

The installation represented in FIG. 6 includes a higher number of central supporting-beams than lateral supporting-beams. It is suitable for a boat having a central keel.

The installation represented in FIG. 7 comprises central beams and side beams which are more numerous than in the arrangement as FIG. 6.

The installation represented in FIG. 8 includes in the group III jacks which support some central beams 3 and some side beams 4 and 5.

The installations as FIGS. 6, 7 and 8 ensure automatic shoring-up between central chocks and lateral chocks. FIG. 3 shows one variant in which the lateral supporting beams 4 and 5 are equipped respectively with jacks 45 and 55 which serve to displace the shoring-chocks 22 and 23 vertically when the hull of the boat is curved. The balancing of the forces between the different jacks is effected as previously and the shoring-up is again achieved automatically.

Figure 5:
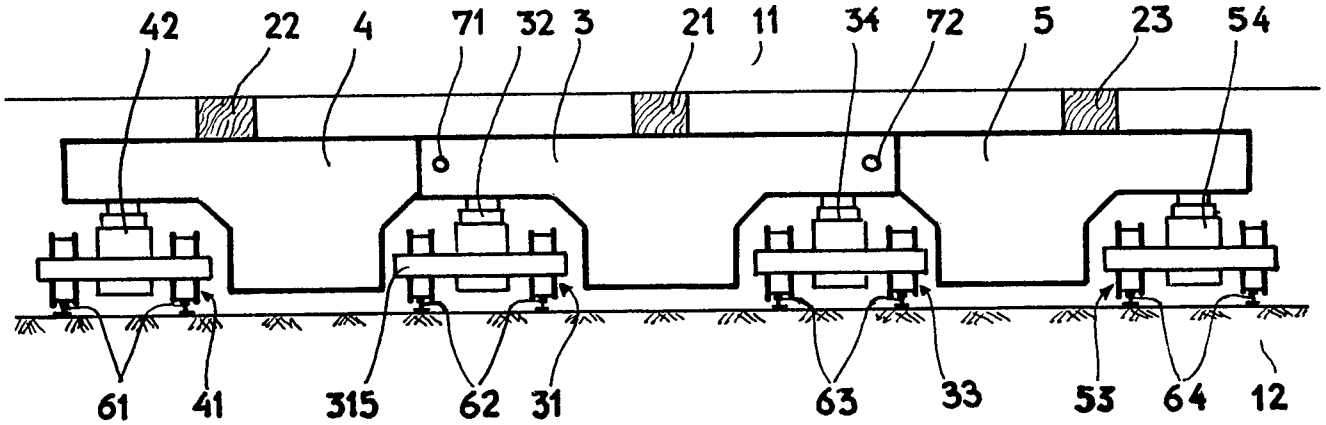
FIG. 5 represents in elevation a particular supporting-beam which may be employed in the installation.

FIG. 5 represents a continuous supporting beam which may be employed in the installation. This continuous beam includes a number of supporting beams perpendicular to the longitudinal axis of the boat. Each beam is hinged to the adjacent beam. The side beam 4 is joined to the central beam 3 by the hinge 71. The side beam 5 is joined to the central beam 3 by the hinge 72. The outer end of the side beam 4 bears by way of a jack on a trolley 41 having four wheels running on the track 61. The outer end of the beam 5 bears by way of a jack on a trolley 53 having four wheels running on the track 64. The coupled ends of the beams 4 and 3 bear by way of a jack on a trolley 31 having four wheels running on the track 62. The coupled ends of the beams 3 and 5 bear by way of a jack on a trolley 33 having four wheels running on the track 63.

The installation is equipped as a whole or in part with self-propelling trolleys 31,33,41,43,51,53. Each self-propelling trolley such as the trolley 31 has at least four independent wheels. Each wheel axle is independent of the axle of the coaxial wheel. The axles of the wheels are guided in axle boxes fixed to the bogie frame such as 315. Two of the four wheels are driving wheels. Each of these driving wheels is coupled to a hydraulic motor. Thus the driving wheel 311 is coupled to the motor 316, the driving wheel 314 being coupled to the motor 317. Each trolley has one driving wheel on each rail. The two driving wheels are symmetrical with respect to the axis of the jack, which enables the motors to be easily housed.

Of course without departing from the scope of the invention variants and improvements in detail may be conceived of and similarly the use of equivalent means may be envisaged.

The trolleys instead of running on rails might run on tracks which are not railway tracks. The installation might include two lines of beams associated with trolleys running on at least three tracks.

I claim:

1. An installation for conveyance of a boat including on the one hand trolleys equipped each with a hydraulic jack and roller members and on the other hand parallel supporting-beams which support the boat which is arranged so that its longitudinal axis is perpendicular to these beams which bear each upon the jacks of two trolleys running on two parallel tracks, the jacks forming at least three groups of jacks connected hydraulically so that the resultants of these groups are located at the corners of a triangle, characterized by the fact that it includes at least three parallel tracks upon which the trolleys run which support the supporting-beams which are arranged so as to form at least two lines of beams which are displaced perpendicularly to the longitudinal axis of the boat.

2. An installation for conveyance of a boat as in claim 1, characterized by the fact that the supporting-beams are arranged along at least three lines.

3. An installation for conveyance of a boat as in claim 2, characterized by the fact that at least one of the groups of jacks connected hydraulically comprises jacks supporting supporting-beams of the central line and jacks supporting supporting-beams of a line to one side.

4. An installation for conveyance of a boat as in claims 2 or 3 characterized by the fact that supporting-beams of a line to one side bear upon trolleys which run along a track along which trolleys run which support the supporting-beams of the central line.

5. An installation for conveyance as in claims 2 or 3, characterized by the fact that it includes jacks which serve to shore the boat on the lateral supporting-beams.

6. An installation for conveyance as in claims 2 or 3, characterized by the fact that at least one of the central supporting-beams is hinged at its ends to two lateral supporting-beams.

* * * * *